US010124340B2

(12) United States Patent
Chung

(10) Patent No.: US 10,124,340 B2
(45) Date of Patent: Nov. 13, 2018

(54) REAGENT STORAGE DEVICE AND BIO-REACTION APPARATUS INCLUDING THE SAME

(71) Applicant: Electronics and Telecommunications Research Institute, Daejeon (KR)

(72) Inventor: Kwang Hyo Chung, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 6 days.

(21) Appl. No.: 15/361,143

(22) Filed: Nov. 25, 2016

(65) Prior Publication Data

US 2017/0157612 A1 Jun. 8, 2017

(30) Foreign Application Priority Data

Dec. 8, 2015 (KR) ..... 10-2015-0174345
Mar. 22, 2016 (KR) ..... 10-2016-0034191

(51) Int. Cl.
*B01L 3/00* (2006.01)

(52) U.S. Cl.
CPC ..... *B01L 3/527* (2013.01); *B01L 3/502* (2013.01); *B01L 2200/16* (2013.01); *B01L 2300/0636* (2013.01); *B01L 2300/087* (2013.01); *B01L 2300/0832* (2013.01); *B01L 2300/123* (2013.01); *B01L 2400/0481* (2013.01)

(58) Field of Classification Search
CPC ..... B01L 3/0268; B01L 3/0241; B01L 3/02; B01L 3/00; B01L 3/502715; B01L 3/52; B01L 3/5027; B01L 3/502; B01L 3/50
USPC ..... 422/504, 502, 501, 500, 50
See application file for complete search history.

(56) References Cited

U.S. PATENT DOCUMENTS 4,929,230 A * 5/1990 Pfleger ..... A61M 5/284 604/191
5,102,388 A * 4/1992 Richmond ..... A61M 5/31596 604/191
5,599,312 A * 2/1997 Higashikawa ..... A61M 5/19 604/191
5,865,799 A * 2/1999 Tanaka ..... A61M 5/284 604/86

(Continued)

OTHER PUBLICATIONS

Chung, Choi et al, Magnetically-actuated blood filter unit attachable to pre-made biochips, Lab Chip, 2012, 12, 3272-3276. (Year: 2012).*

(Continued)

*Primary Examiner* — Christine T Mui
(74) *Attorney, Agent, or Firm* — William Park & Associates Ltd.

(57) ABSTRACT

The present disclosure relates to a reagent storage device and a bio-reaction apparatus including the same. Provided is a reagent storage device connected to a biochip to provide reagents into the biochip. The reagent storage device includes a storage container having a tube shape of which one end is opened, and the other end opposite to the one end is closed and a plurality of diaphragms provided in the storage container and installed to be closely attached to an inner wall of the storage container. Here, the diaphragms are spaced apart from each other in one direction in which the one end and the other end are disposed opposite to each other, and each of the diaphragms includes a through-hole passing therethrough.

20 Claims, 10 Drawing Sheets

(56) References Cited

U.S. PATENT DOCUMENTS

| | | | | |
|---|---|---|---|---|
| 7,001,362 | B2 * | 2/2006 | Vincent | A61M 5/284 604/191 |
| 8,169,006 | B2 | 5/2012 | Kim et al. | |
| 8,834,811 | B2 | 9/2014 | Chung et al. | |
| 2010/0133510 | A1 | 6/2010 | Kim et al. | |
| 2013/0149216 | A1 | 6/2013 | Chung et al. | |
| 2015/0152481 | A1 | 6/2015 | Battrell et al. | |

OTHER PUBLICATIONS

Chung et al, Electronic Supplementary Material (ESI) for Lab on a Chip, Magnetically-actuated blood filter unit attachable to premade biochips, The Royal Society of Chemistry 2012, p. 1-7. (Year: 2012).*

O.D. Rahmanian and D.L. Devoe, "Low-Cost Integrated Screw-Based Micropumps for Thermoplastic Microfluidic Devices", 19th International Conference on Miniaturized Systems for Chemistry and Life Sciences, Oct. 25-29, 2015, p. 1776-1778.

D. Baumann et al., "Fully Automated Stick-Packaging for Precise Liquid Reagent Pre-Storage and Release in Lab-on-a-Chip Disposables", 19th International Conference on Miniaturized Systems for Chemistry and Life Sciences, Oct. 25-29, 2015, p. 1451-1453.

Wooseok Jung et al., "An innovative sample-to-answer polymer lab-on-a-chip with on-chip reservoirs for the POCT of thyroid stimulating hormone (TSH)," The Royal Society of Chemistry, Sep. 18, 2013, p. 4653-4662.

* cited by examiner

REAGENT STORAGE DEVICE AND BIO-REACTION APPARATUS INCLUDING THE SAME

CROSS-REFERENCE TO RELATED APPLICATIONS

This U.S. non-provisional patent application claims priority under 35 U.S.C. § 119 of Korean Patent Application Nos. 10-2015-0174345, filed on Dec. 8, 2015, and 10-2016-0034191, filed on Mar. 22, 2016, the entire contents of which are hereby incorporated by reference.

BACKGROUND

The present disclosure herein relates to a reagent storage device and a bio-reaction apparatus including the same, and more particularly, to a reagent storage device capable of storing a plural kinds of reagents and a bio-reaction apparatus including the same.

A biochip for easily and rapidly diagnostic-analyzing a biological sample has been developed. A method for biochip analysis includes a method in which only the biological sample is injected and a method in which a plural kinds of reagents are sequentially injected. Although the former method is simple, which is regarded as an advantage, it may not be applied to diagnostic analysis requiring a complex biochemical reaction. The latter method has an advantage in which a complex reaction may be performed to be applied to various analysis protocols and a disadvantage in which a complex driving device for storing and supplying a reagent is necessary.

When recent trend for biochip development is reviewed, a high functional biochip having high sensitiveness, quantification, reproducibility, and multi-element simultaneous analysis is required to build a mainstream. Also, a lab-on-a-chip-type biochip capable of sequentially performing sample pretreatment, analysis, and measurement in a single chip has been developed. As described above, the complex reaction protocol needs to be realized with reproducibility so as to develop the high functional lab-on-a-chip-type biochip, which may be realized by sequential, quantified, and automatic supply of the reagent.

Until now, in most of lab-on-a-chip, a necessary reagent is stored at the outside of the chip and supplied to the lab-on-a-chip by using an external pumping device. The above-described method for storing and supplying the reagent has a problem in which the external device may be complex and huge in size. Although the lab-on-a-chip on which a micro-pump is installed has been developed to remove the external pumping device, a complex process and additional costs are required to install the micro-pump on the chip, the micro-pump on the chip is difficult to be integrated with other components, and furthermore the reagent is still not stored therein.

To overcome the above-described problems, a few techniques for storing the reagent on the conventional lab-on-a-chip have been suggested. First, a chamber for storing the reagent is installed on the chip, the reagent is injected therein, and then the chamber is sealed. In this case, a reagent injection hole and a fine passage connected to the storage chamber need to be sealed, which is mainly realized by using a micro-valve or a phase change material. However, a process and a control operation for opening/closing the fine passage is rather complex. As an alternative method, a method for attaching a pouch-type reagent storage onto the chip is provided. In this case, the pouch is pressed to be attached to the chip by a manual method or using a mechanical device. This method has a problem in which reproducibility of flow rate may be reduced when the reagent is supplied and additional mechanical control is required.

As described above, to store the reagent, the reagent supply having homeostasis maintenance of the reagent, realization at low costs, simple operation, and reproducibility is required. However, the related art has a limitation to satisfy the above-described requirement conditions.

SUMMARY

The present disclosure provides a reagent storage device capable of maintaining homeostasis of a reagent, being realized at a low cost, and providing the reagent through a simple operation and a bio-reaction apparatus including the same.

An embodiment of the inventive concept provides a reagent storage device connected to a biochip to provide reagents into the biochip, the reagent storage device including: a storage container having a tube shape of which one end is opened, and the other end opposite to the one end is closed; and a plurality of diaphragms provided in the storage container and installed to be closely attached to an inner wall of the storage container. Here, the diaphragms are spaced apart from each other in one direction in which the one end and the other end are disposed opposite to each other, and each of the diaphragms includes a through-hole passing therethrough.

In an embodiment, the storage container may have a plurality of storage spaces separated by the diaphragms, the reagents may be respectively stored in the plurality of storage spaces, and at least some of the reagents may be different from each other in kind.

In an embodiment, the diaphragms may include a first diaphragm and a second diaphragm, which are disposed from a inlet of the storage container in the one direction, and the reagents may include a first reagent disposed between the first diaphragm and the second diaphragm and a second reagent separated from the first reagent with the second diaphragm therebetween. Here, the first diaphragm may move toward the second diaphragm by external force applied thereto, and while the first diaphragm moves, the first reagent may be discharged to the outside of the storage container through the through-hole of the first diaphragm.

In an embodiment, while the first reagent is discharged, a position of the second diaphragm may be maintained.

In an embodiment, the through-hole may completely pass through the corresponding diaphragm in the one direction, and a ratio of a diameter of the through-hole to a length of the through-hole may be about 0.02 to about 0.2.

In an embodiment, the through-holes of the diaphragms may be aligned with each other in a straight line parallel to the one direction.

In an embodiment, each of the diaphragms may be made of a material having elasticity.

In an embodiment, the through-hole may be filled with air or oil.

In an embodiment of the inventive concept, a bio-reaction apparatus includes: a biochip configured to perform a bio-reaction; and a reagent storage device connected to one end of the biochip. Here, the reagent storage device includes: a barrel-shaped storage container having an opened inlet; a plurality of diaphragms installed in the storage container so as to be closely attached to an inner wall of the storage container, in which each of the plurality of diaphragms includes a through-hole passing therethrough; and reagents respectively stored in storage spaces, which are separated by the diaphragms, of the storage container, in which the reagent storage device is configured to sequentially provide the reagents into the biochip.

In an embodiment, a diaphragm, which is the most adjacent to the inlet, of the diaphragms may be defined as a first diaphragm, and the biochip may include a body part having a tube shape and a reagent transfer channel in the body part. Here, the body part may have an end connected to the first diaphragm, and the reagents may be transferred to the reagent transfer channel.

In an embodiment, the biochip may further include a reagent injection hole provided in the one end of the body part and connected to the reagent transfer channel, and the reagent injection hole may be connected to the through-hole of the first diaphragm.

In an embodiment, the bio-reaction apparatus may further include a connecting member disposed between the one end of the body part and the first diaphragm. Here, the connecting member may include a connecting passage configured to connect the reagent injection hole to the through-hole of the first diaphragm.

In an embodiment, the bio-reaction apparatus may further include a driving member connected to the other end of the biochip, which is disposed opposite to the one end. Here, the driving member may be configured to apply external force to the first diaphragm through the biochip.

In an embodiment, a diaphragm, which is disposed adjacent to the first diaphragm, of the diaphragms may be defined as a second diaphragm, and a reagent, which is disposed between the first diaphragm and the second diaphragm, of the reagents may be defined as a first reagent. Here, the first diaphragm may linearly move toward the second diaphragm by the applied external force, and while the first diaphragm linearly moves, the first reagent may be transferred to the reagent transfer channel.

In an embodiment, while the first reagent is transferred to the reagent transfer channel, a position of the second diaphragm may be maintained.

In an embodiment, a target material for performing the bio-reaction may be provided in the reagent transfer channel.

In an embodiment, the body part may be defined as a first body part, and the reagent transfer channel may be defined as a first reagent transfer channel, and the biochip may include: a second body part; a second reagent transfer channel in the second body part; and a connecting part configured to connect the first reagent transfer channel to the second reagent transfer channel.

In an embodiment, the reagents may be transferred to the second reagent transfer channel through the first reagent transfer channel and the connecting part, and a target material for performing the bio-reaction may be provided to the second reagent transfer channel.

In an embodiment, the through-holes of the diaphragms may be aligned with each other in a straight line parallel to one direction in which the diaphragms are disposed.

In an embodiment, each of the diaphragms may be made of a material having elasticity.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
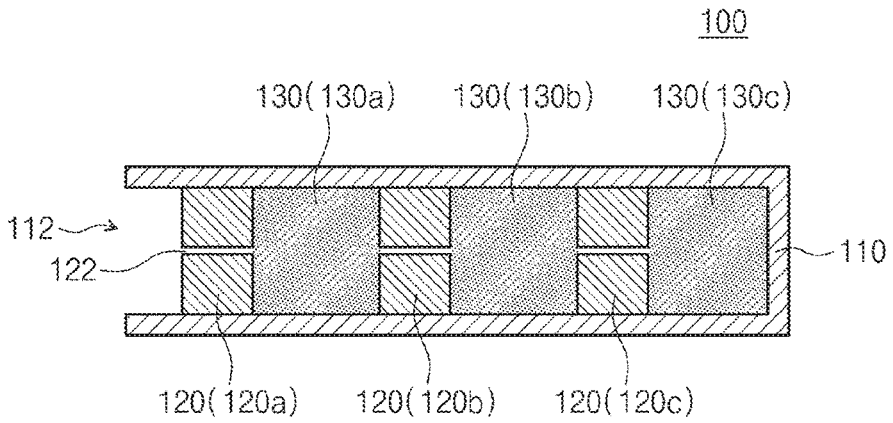
FIG. 1 is a view for explaining a reagent storage device according to embodiments of the inventive concept.

Advantages and features of the present invention, and implementation methods thereof will be clarified through following embodiments described with reference to the accompanying drawings. The present invention may, however, be embodied in many different forms and should not be construed as being limited to the embodiments set forth herein. Rather, these embodiments are provided so that this disclosure will be thorough and complete, and will fully convey the concept of the invention to those skilled in the art. Further, the present invention is only defined by scopes of claims. Like reference numerals refer to like elements throughout.

In the following description, the technical terms are used only for explaining a specific exemplary embodiment while not limiting the present disclosure. The terms of a singular form may include plural forms unless referred to the contrary. The meaning of "include," "comprise," "including," or "comprising," specifies a property, a region, a fixed number, a step, a process, an element and/or a component but does not exclude other properties, regions, fixed numbers, steps, processes, elements and/or components.

Additionally, the embodiment in the detailed description will be described with sectional views and plan views as ideal exemplary views of the present invention. Also, in the figures, the dimensions of layers and regions are exaggerated for clarity of illustration. Accordingly, shapes of the exemplary views may be modified according to manufacturing techniques and/or allowable errors. Therefore, the embodiments of the present invention are not limited to the specific shape illustrated in the exemplary views, but may include other shapes that may be created according to manufacturing processes. For example, an etched region having a right angle illustrated in the drawings may have a round shape or a shape having a predetermined curvature. Areas exemplified in the drawings have general properties, and are used to illustrate a specific shape of a semiconductor package region. Thus, this should not be construed as limited to the scope of the present invention.

Hereinafter, exemplary embodiments will be described in detail with reference to the accompanying drawings.

Figure 2:
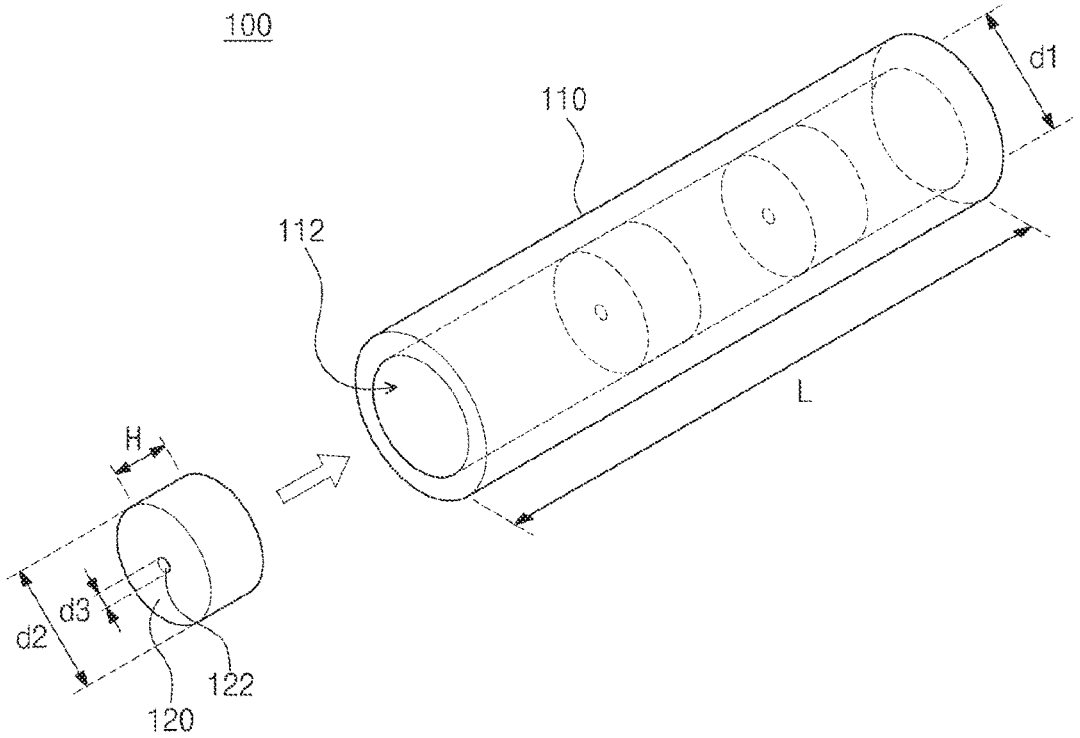
FIGS. 2 and 4 are exemplary perspective views of the reagent storage device of FIG. 1.
Figure 3A:
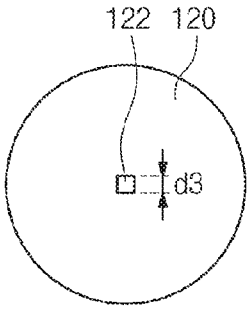
FIGS. 3A and 3B are cross-sectional views for explaining a diaphragm of the reagent storage device according to embodiments of the inventive concept.
Figure 3B:
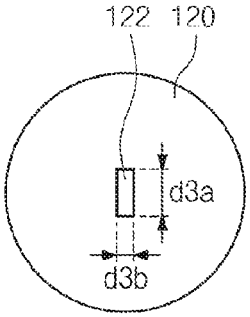
Figure 4:
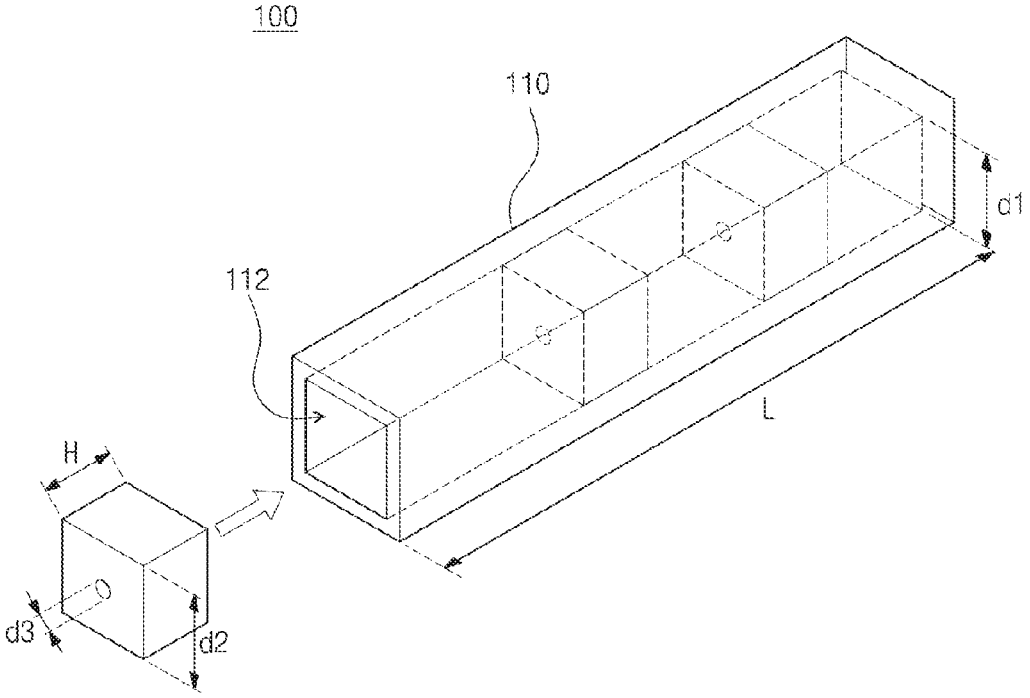

FIG. 1 is a view for explaining a reagent storage device according to embodiments of the inventive concept. FIGS. 2 and 4 are exemplary perspective views of the reagent storage device of FIG. 1. FIGS. 3A and 3B are cross-sectional views for explaining a diaphragm of the reagent storage device according to embodiments of the inventive concept.

Referring to FIG. 1, a reagent storage device 100 may include a storage container 110 and a plurality of diaphragms 120 provided in the storage container 110. The diaphragms 120 may separate an inner space of the storage container 110 into a plurality of storage spaces, and reagents 130 may be respectively stored in the plurality of storage spaces.

In detail, the storage container 110 may have a container shape having an opened inlet 112. In other words, the storage container 110 may have a tube shape of which one end is opened and the other end disposed opposite to the one end is closed. The diaphragms 120 may be provided through the opened inlet 112 of the storage container 110 and installed to be closely attached to an inner wall of the storage container 110. That is, the diaphragms 120 may have a shape capable of being closely attached to the inner wall of the storage container 110 and being inserted therein. Also, each of the diaphragms 120 may include a through-hole 122 passing therethrough. The through-hole 122 serves as a passage through which the reagents 130 are transferred. The storage container 110 may be made of glass or a plastic material. Desirably, the storage container 110 may be made of a transparent plastic material. However, embodiments of the inventive concept are not limited thereto. Also, the diaphragms 120 may be made of a material having elasticity. For example, the diaphragms 120 may include rubber or polydimethylsiloxane (PDMS).

The reagent storage device 100 according to embodiments of the inventive concept may be connected to a biochip (refer to 200 in FIG. 6A) to sequentially provide the reagents 130 into the biochip 200. A biomarker contained in a biological sample (e.g., blood, excrement, or saliva), i.e., a target material, may be provided in the biochip 200, and the reagents 130 may include a plural kinds of reagents capable of sequentially reacting with the target material. For the supply of the reagents 130, the diaphragms 120 may be sequentially and linearly moved by external force to press the reagents 130, and, accordingly, the reagents 130 may be discharged to the outside of the storage container 110 through the through-hole 122 formed in each of the diaphragms 120. Detailed description for the operation of the reagent storage device 100 will be described later. Hereinafter, a configuration of the reagent storage device 100 will be described in more detail with reference to FIG. 2.

Referring to FIGS. 1 and 2, the storage container 110 may have a cylindrical shape having the opened inlet 112. Desirably, the storage container 110 may have a lengthy shape having a major axis in a direction in which both ends thereof face each other. That is, the storage container 110 may have a length L in the direction, in which the both ends thereof are disposed opposite to each other, and an inner diameter d1. The length L and/or the inner diameter d1 of the storage container 110 may be realized in various sizes according to the number of kinds of the necessary reagents 130 and/or the amounts of the reagents 130. For example, when the number of the kinds of the reagents 130 that is necessary to analyze the target material is large, the number of the diaphragms 120 that is necessary to separately store the reagents may increase, and thus the length L of the storage container 110 may be lengthened. Also, when the amount of each of the necessary reagents 130 is great, the length L and/or the inner diameter d1 of the storage container 110 may increase. In the drawings, although three diaphragms 120 are provided in the storage container 110, and three kinds of reagents 130 are stored separately by the diaphragms, embodiments of the inventive concept are not limited thereto. Hereinafter, as a matter of convenience, three diaphragms 120 may be respectively referred to as first to third diaphragms 120*a*, 120*b*, and 120*c*, and the three kinds of reagents 130 may be respectively referred to as first to third reagents 130*a*, 130*b*, and 130*c*.

Each of the diaphragms 120 may have a hollow cylindrical shape in correspondence to the shape of the storage container 110. Each of the diaphragms 120 may have an outer diameter d2, an inner diameter d3 (i.e., a diameter of the through-hole 122), and a thickness H (or length) in a direction through which the through-hole 122 passes. The thickness of the diaphragm 120 may correspond to the length of the through-hole 122. As the diaphragms 120 is made of a material having elasticity, the diaphragm 120 that is not installed in the storage container 110 may have the outer diameter d2 greater than the inner diameter d1 of the storage container 110 within an expandable range. In this case, the diaphragms 120 may be compressed to be provided in the storage container 110 and strongly and closely attached to the inner wall of the storage container 110 by restoring force.

The through-hole 122 may be realized in a size capable of minimizing that the reagents 130 separated with the diaphragm 120 therebetween are diffused and mixed with each other through the through-hole 122 in a state in which external force is not applied to the diaphragms 120 in the storage container 110. According to embodiments, a ratio of the diameter d3 of the through-hole 122 to the length H of the through-hole 122 (i.e., ratio of the inner diameter d3 of the diaphragm 120 to the thickness H of the diaphragm 120) may be about 0.02 to about 0.2. When the diameter d3 of the through hole 122 is large, the length H of the through-hole 122 may be relatively long to prevent the reagents 130 disposed adjacent to each other with the diaphragm 120 therebetween from being diffused and mixed. On the other hand, when the size of the through hole 122 is small, since flow resistivity of the reagent 130 passing through the through-hole 122 increases, the external force applied to the diaphragm 120 may increase to transfer the reagent therethrough. For example, the through-hole 122 may have a diameter of about 0.1 mm to about 1 mm. Meanwhile, the through-hole 122 may be filled with air or an inert liquefied material such as oil to prevent the reagents 130 from being diffused therebetween.

In this example, although the through-hole 122 has a cross-section of a circle, embodiments of the inventive concept are not limited thereto. For another example, the through-hole 122 may have a cross-section of a square as illustrated in FIG. 3A. In this case, the through-hole 122 may have a width d3. For example, the through-hole 122 may have the width d3 of about 0.1 mm to about 1 mm. For another example, the through-hole 122 may have a cross-section of a rectangle as illustrated in FIG. 3B. In this case, the through-hole 122 may have a first width d3*a* in a major axis direction and a second width d3*b* in a minor axis direction. For example, the first width d3*a* may be less than about 1 mm, and the second width d3*b* may be greater than about 0.1 mm.

The diaphragms 120 may be installed in the storage container 110 so that the through-holes 122 are aligned in a straight line parallel to a longitudinal direction of the storage container 110. For example, in view of one cross-section, each of the through-holes 122 may be formed in a central portion of each of the diaphragms 120. In this case, the through-holes 122 of the diaphragms 120 installed in the storage container 110 may be easily aligned in the straight line. However, embodiments of the inventive concept are not limited thereto.

According to another embodiment, as illustrated in FIG. 4, the storage container 110 may have a rectangular (e.g. square) barrel shape having an opened inlet 112. The storage container 110 may have a length L in a direction in which both ends thereof face each other and an inner width d1. Also, the diaphragms 120 may have a shape corresponding to that of the storage container 110, i.e., a hollow rectangular pillar shape. Each of the diaphragms 120 may have an outer width d2, an inner diameter d3, and a length H (or thickness). Since contents regarding the sizes d1 and L of the storage container 110 and the sizes d2, d3, and H of each of the diaphragms 120 are the same as those described with reference to FIG. 2, detailed description will be omitted.

According to another embodiment, although not shown, the storage container 110 may have a triangular, hexagonal, or octagonal barrel shape (i.e., polygonal barrel shape) having an opened inlet 112. Also, each of the diaphragms 120 may have a hollow triangular, hexagonal, or octagonal pillar shape corresponding to that of the storage container 110.

Figure 5:
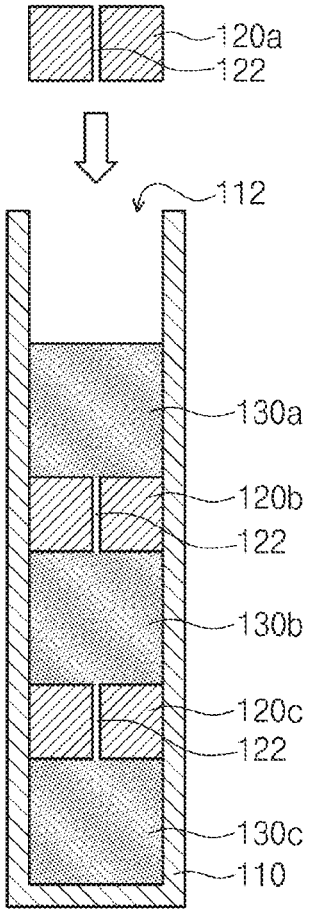
FIG. 5 is a view for explaining a method for storing reagents in a storage container of FIG. 1.

FIG. 5 is a view for explaining a method for storing reagents in the storage container of FIG. 1.

Referring to FIG. 5, in a state in which the opened inlet 112 of the storage container 110 faces upward, a plural kinds of reagents 130*a*, 130*b*, and 130*c* and diaphragms 120*a*, 120*b*, and 120*c* may be alternately provided in the storage container 110 through the inlet 112. For example, the third reagent 130*c* may be injected into the storage container 110, and, subsequently, the third diaphragm 120*c* may be installed in the storage container 110 so as to be closely attached to the inner wall of the storage container 110. Although the third diaphragm 120*c* is installed to contact the third reagent 130*c*, an embodiment of the inventive concept is not limited thereto. As necessary, inert liquid such as oil may be filled in the through-hole 122 of the third diaphragm 120*c*. Thereafter, the second reagent 130*b* and the second diaphragm 120*b* may be sequentially provided in the storage container 110, and, similarly, the first reagent 130*a* and the first diaphragm 120*a* may be sequentially provided in the storage container 110. As necessary, the inert liquid such as oil may be filled in the through-hole 122 of the second diaphragm 120*b* and the through-hole 122 of the first diaphragm 120*a*. As described above, the first to third diaphragms 120*a*, 120*b*, and 120*c* that are spaced apart from each other in the longitudinal direction of the storage container 110 may be installed in the storage container 110, and the first to third reagents 130*a*, 130*b*, and 130*c* may be respectively stored in the storage spaces of the storage container 110, which are divided by the diaphragms 120.

According to embodiments of the inventive concept, as the reagents and the diaphragms are alternately injected and installed in the barrel shaped storage container having the opened inlet, the reagent storage device capable of storing the plural kinds of reagents may be realized. Accordingly, the reagent storage device that may be manufactured at a low cost and maintain homeostasis of the reagents may be provided.

Figure 6A:
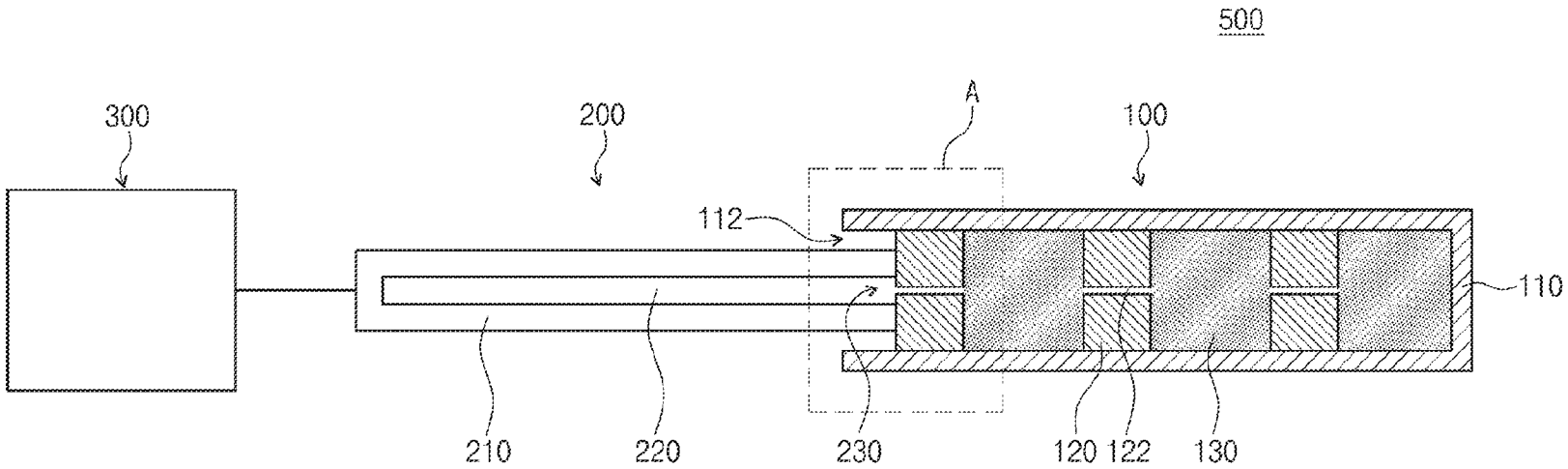
FIGS. 6A and 6B are views for explaining a bio-reaction apparatus including the reagent storage device of FIG. 1.
Figure 6B:
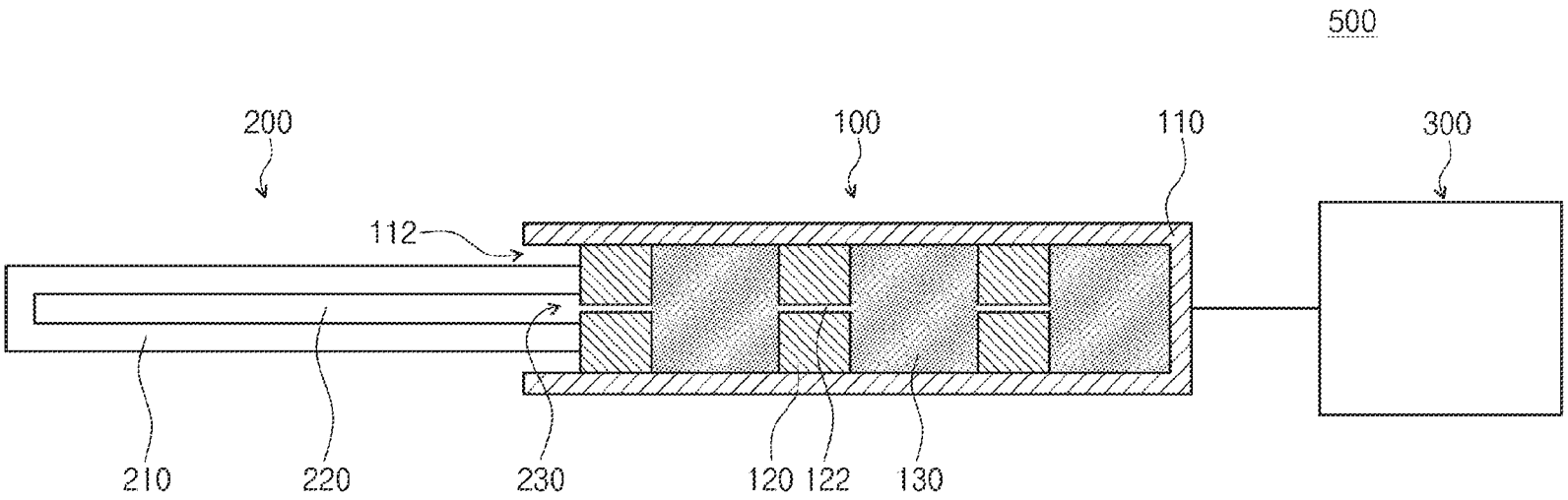
Figure 7:
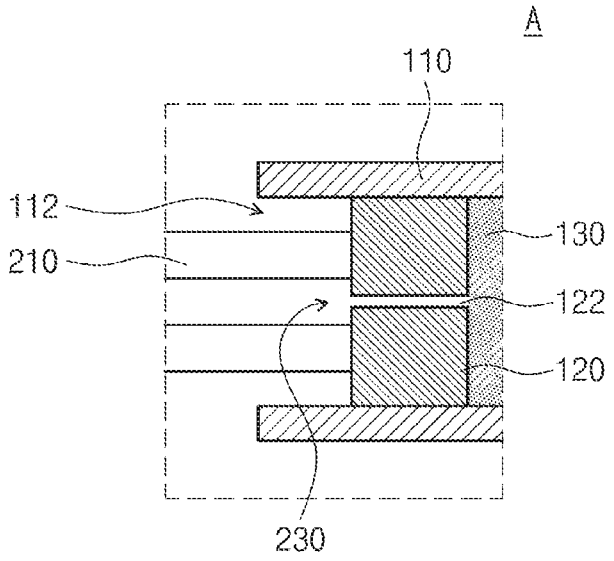
FIGS. 7 and 8 are enlarged views corresponding to a portion A of FIG. 6A.
Figure 8:
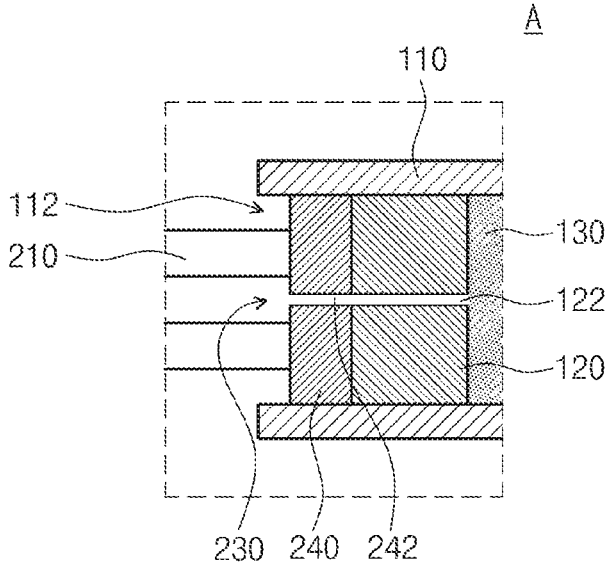

FIGS. 6A and 6B are views for explaining a bio-reaction apparatus including the reagent storage device of FIG. 1. FIGS. 7 and 8 are enlarged views corresponding to portion A of FIG. 6A. A bio-reaction apparatus 500 in FIG. 6A and a bio-reaction apparatus 500 in FIG. 6B may be the same as each other except for a position to which a driving member 300 is connected. Hereinafter, the bio-reaction apparatus 500 in FIG. 6A will be mainly described for simplicity of description.

Referring to FIG. 6A, the bio-reaction apparatus 500 may include the reagent storage device 100, the biochip 200, and the driving member 300.

As described above with reference to the drawings, the reagent storage device 100 may include the storage container 110, the diaphragms 120 in the storage container 110, and the plural kinds of reagents 130 respectively stored in the storage spaces of the storage container 110. The reagent storage device 100 may be connected to the biochip 200 to sequentially provide the reagents 130 into the biochip 200.

The biochip 200 may perform a bio-reaction (or biochemical reaction) by using the reagents 130 sequentially provided from the reagent storage device 100. For example, the biochip 200 may include a lab-on-a-chip-type biochip. According to an embodiment, the biochip 200 may be manufactured in a capillary tube type, and inserted into the storage container 110 and connected to the diaphragm 120 of the reagent storage device 100.

In detail, the biochip 200 may include a body part 210 and a reagent transfer channel 220 formed in the body part 210. The body part 210 may have a tube shape, and have an outer diameter or an outer width less than the inner diameter d1 (refer to FIG. 2) of the storage container 110 so that the body part 210 is inserted into the storage container 110. For example, the body part 210 may be made of silicon, glass, plastic polymer, or a combined material thereof. A reagent injection hole 230, through which the reagents 130 of the reagent storage device 100 are injected, may be provided to one end of the reagent transfer channel 220. The one end of the body part 210, in which the reagent injection hole 230 is provided, may be inserted into the storage container 110 and directly connected to the diaphragm 120 installed adjacent to the inlet 112 of the storage container 110. That is, as illustrated in FIG. 7, the one end of the body part 210 may be directly connected to the first diaphragm 120*a*. Here, the reagent injection hole 230 of the biochip 200 may be aligned and connected to the through-hole 122 of the first diaphragm 120*a*.

According to another embodiment, the biochip 200 may be connected to the first diaphragm 120*a* by using a connecting member 240. That is, as illustrated in FIG. 8, the one end of the body part 210 may be coupled to the connecting member 240, and the connecting member 240 may be inserted into the storage container 110 through the inlet 112 of the storage container 110 and connected to the first diaphragm 120*a*. The connecting member 240 may include a connecting passage 242 therein, and the connecting passage 242 may connect the reagent injection hole 230 of the biochip 200 to the through-hole 122 of the first diaphragm 120*a*. The connecting member 240 may be closely attached to the inner wall of the storage container 110. For example, although the connecting member 240 may be made of the same material as that of each of the diaphragms 120, embodiments of the inventive concept are not limited thereto. As a result, the one end of the biochip 200 may be inserted into the storage container 110 and directly or indirectly connected to the diaphragm 120 of the reagent storage device 100.

Meanwhile, the body part 210 may further include a discharge hole (not shown) for discharging the reagents 130 transferred into the reagent transfer channel 220 and/or a biological sample injection hole (not shown) for injecting the biological sample into the reagent transfer channel 220.

According to the embodiment, a target material may be provided to the reagent transfer channel 220. The target material may be a biological material contained in the biological sample (e.g., blood, excrement, or saliva) to be analyzed. For example, the target material may include protein, a cell, a virus, nucleic acid, an organic molecule, or an inorganic molecule. In case of the protein, any biomaterial such as antigen, antibody, matrix protein, and coenzyme may be possible. Also, in case of the nucleic acid, DNA, RNA, PNA, LNA, or hybrid thereof may be possible.

According to an embodiment, the driving member 300 may be connected to the biochip 200 to provide driving force to the biochip 200. The biochip 200 may be linearly moved by the driving force of the driving member 300 to press the diaphragm 120 connected thereto. For example, as illustrated in FIG. 6A, the driving member 300 may be directly or indirectly connected to the other end of the body part 210, and the body part 210 may be linearly moved in a longitudinal direction thereof by the driving force of the driving member 300 to press the first diaphragm 120*a* connected to the one end thereof. Alternatively, the driving member 300 may be connected to a side portion of the body part 210.

According to another embodiment, the driving member 300 may be connected to the reagent storage device 100 to provide the driving force to the reagent storage device 100. For example, as illustrated in FIG. 6B, the driving member 300 may be directly or indirectly connected to the other end of the storage container 110. The storage container 110 may be linearly moved by the driving force of the driving member 300 in a direction from the other end to the opened one end thereof. Here, the biochip 200 may be fixed, and, resultantly, the biochip 200 may press the diaphragm 120 connected thereto.

The driving member 300 may include a driving part for generating the driving force, a power transmission part for transmitting rotational force generated from the driving part to the body part 210, and a control part for controlling the driving part. The driving part may include, e.g., a motor, and the power transmission part may include, e.g., a gear. The control part may control the driving part to adjust the driving force transmitted to the diaphragm 120 through the body part 210. Through the above-described adjustment of the driving force, transfer speed of the reagents 130 discharged from the storage container 110 may be controlled.

When the reagents 130 are provided from the reagent storage device 100 to the reagent transfer channel 220, the bio-reaction may be performed in the reagent transfer channel 220. A biosignal according to the bio-reaction may be measured by using various physicochemical detection methods. For example, the biochip 200 may be detachably provided to the reagent storage device 100, and the biochip 200 detached from the reagent storage device 100 after the bio-reaction is performed may be used for various detection devices for measuring the biosignal. For another example, as a measuring unit (e.g., a light source and an optical detector) for detecting a result of the biosignal may be mounted on the bio-reaction device 500, a biomaterial detection system for performing the bio-reaction and detecting the biosignal according to the bio-reaction may be provided.

FIGS. 9A to 9E are views for explaining a method for operating the bio-reaction apparatus of FIG. 6A. That is, FIGS. 9A to 9E are views for explaining a method for providing the reagents from the reagent storage device into the biochip.

Figure 9A:
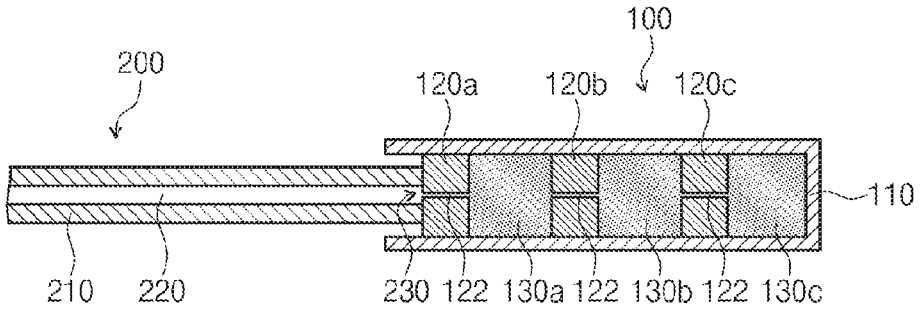
FIGS. 9A to 9E are views for explaining a method for operating the bio-reaction apparatus of FIG. 6A.

Referring to FIGS. 6A and 9A, the bio-reaction device 500 in a state in which external force is not applied to the first diaphragm 120*a* is provided. That is, the reagent storage device 100 including the first to third reagents 130*a*, 130*b*, and 130*c* and the biochip 200 including the body part 210 connected to the first diaphragm 120*a* may be provided. Here, the reagent injection hole 230 provided in the body part 210 may be aligned and connected to the through-hole 122 of the first diaphragm 120*a*.

Figure 9B:
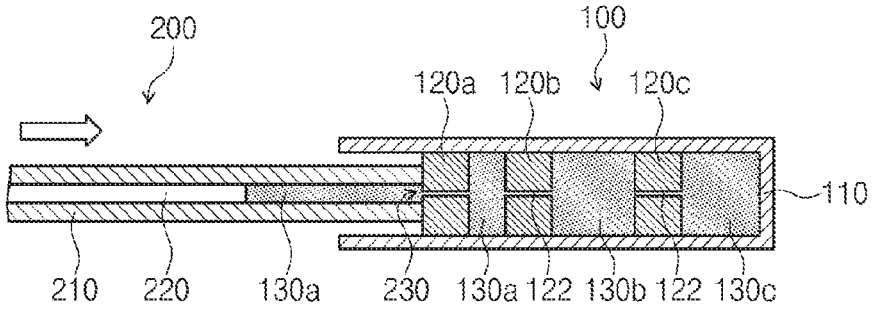

Referring to FIGS. 6A and 9B, the body part 210 is linearly moved in the longitudinal direction thereof by the driving member 300 to apply the external force to the first diaphragm 120*a*. The first diaphragm 120*a* to which the external force is applied may be linearly moved in the longitudinal direction of the storage container 110 (i.e., direction from one end to the other end of the storage container 110). Accordingly, the first reagent 130*a* may be compressed, and the compressed first reagent 130*a* may be discharged to the reagent injection hole 230 through the through-hole 122 of the first diaphragm 120*a*. Meanwhile, the second diaphragm 120*b* may maintain a stopped state while the first reagent 130*a* is transferred. In other words, a position of the second diaphragm 120*b* may be maintained while the first reagent 130*a* is transferred. The reason is that as the diaphragms 120 are made of the material having elasticity and firmly and closely attached to the inner wall of the storage container 110, shear resistance caused by the close attachment between the second diaphragm 120*b* and the storage container 110 may be greater than flow resistance caused by the transfer of the first reagent 130*a*. Accordingly, the first reagent 130*a* and the second reagent 130*b* may be prevented from being mixed while the first reagent 130*a* is transferred. The driving member 300 may control the external force transmitted to the first diaphragm 120*a* through the body part 210 to adjust the transfer speed of the first reagent 130*a*.

Figure 9C:
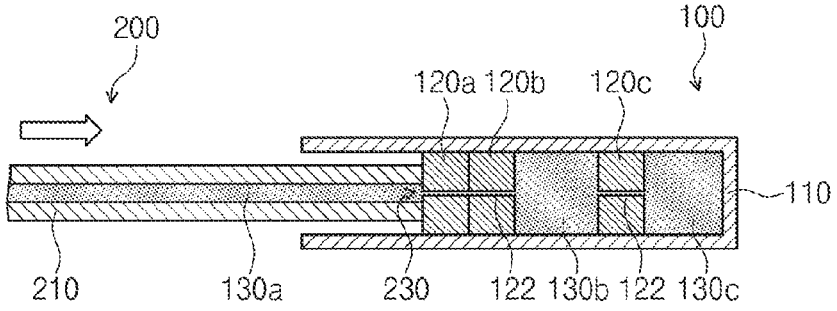

Referring to FIGS. 6A and 9C, the body part 210 may be linearly moved in the longitudinal direction of the storage container 110 until the first diaphragm 120*a* contacts the second diaphragm 120*b*. While the body part 210 is linearly moved until the first diaphragm 120*a* contacts the second diaphragm 120*b*, all of the first reagent 130*a* may be transferred to the reagent transfer channel 220 of the biochip 200. Meanwhile, as the first diaphragm 120*a* and the second diaphragm 120*b* are physically connected to each other, the external force applied to the first diaphragm 120*a* may be transmitted to the second diaphragm 120*b*. Accordingly, the second diaphragm 120*b* may be moved together with the first diaphragm 120*a* in the longitudinal direction of the storage container 110.

Figure 9D:
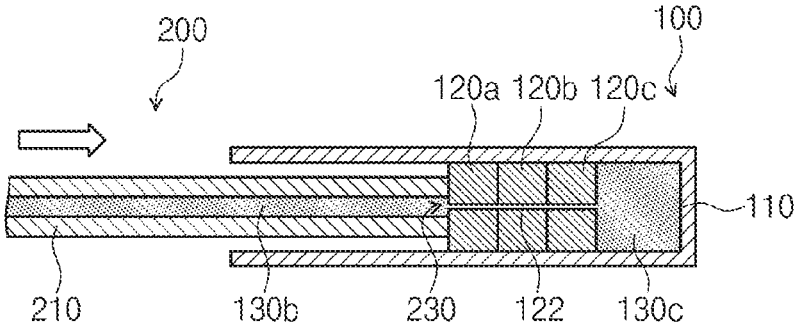

Referring to FIGS. 6A and 9D, the body part 210 may be linearly moved in the longitudinal direction of the storage container 110 until the second diaphragm 120*b* contacts the third diaphragm 120*c*. While the body part 210 is linearly moved until the second diaphragm 120*b* contacts the third diaphragm 120*c*, all of the second reagent 130*b* may be transferred to the reagent transfer channel 220 of the biochip 200. Here, the first reagent 130*a* that is previously transferred may be discharged through the discharge hole (not shown). Meanwhile, as the second diaphragm 120*b* and the third diaphragm 120*c* are physically connected to each other, the external force applied to the first diaphragm 120*a* may be transmitted to the third diaphragm 120*c* through the second diaphragm 120*b*. Accordingly, the third diaphragm 120*c* may be moved together with the first and second diaphragms 120*a* and 120*b* in the longitudinal direction of the storage container 110.

Figure 9E:
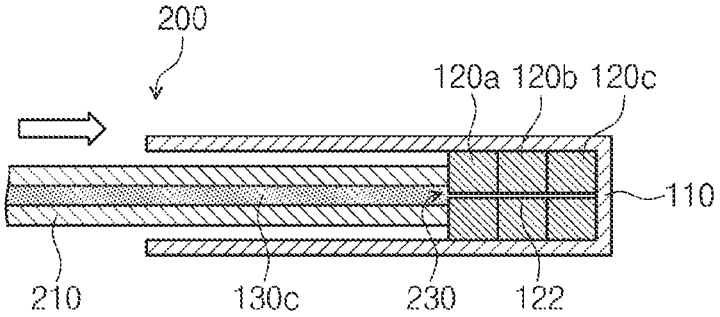

Referring to FIGS. 6A and 9E, the body part 210 may be linearly moved in the longitudinal direction of the storage container 110 until the third diaphragm 120*c* contacts the other end of the storage container 110. While the body part 210 is linearly moved until the third diaphragm 120*c* contacts the other end of the storage container 110, all of the third reagent 130*c* may be transferred to the reagent transfer channel 220 of the biochip 200. Here, the second reagent 130*b* that is previously transferred may be discharged through the discharge hole (not shown).

According to embodiments of the inventive concept, the external force may be applied to the diaphragms connected to the biochip by using the simple driving member to sequentially and linearly move the diaphragms, and the reagents pressed by the linear movement of the diaphragms may pass through the through-holes respectively defined in the diaphragms and sequentially provided into the biochip. Accordingly, the reagent storage device capable of supplying the reagent with reproducibility through the simple operation and the bio-reaction apparatus including the same.

Figure 10:
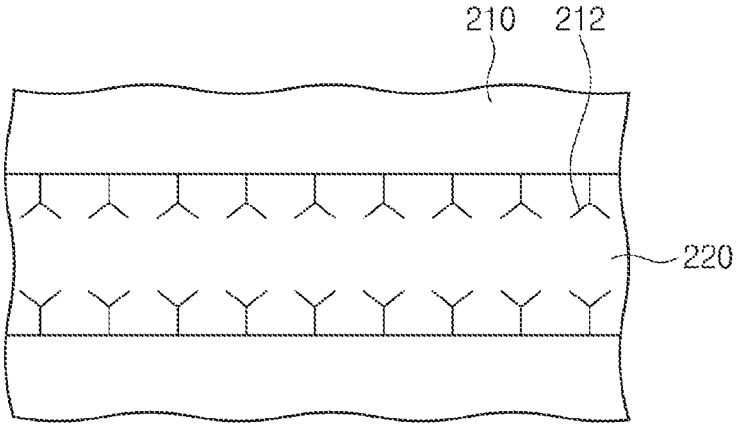
FIGS. 10 and 11 are views for explaining an example in which a bio-reaction is performed by using the bio-reaction apparatus and enlarged views of a portion of the biochip.
Figure 11:
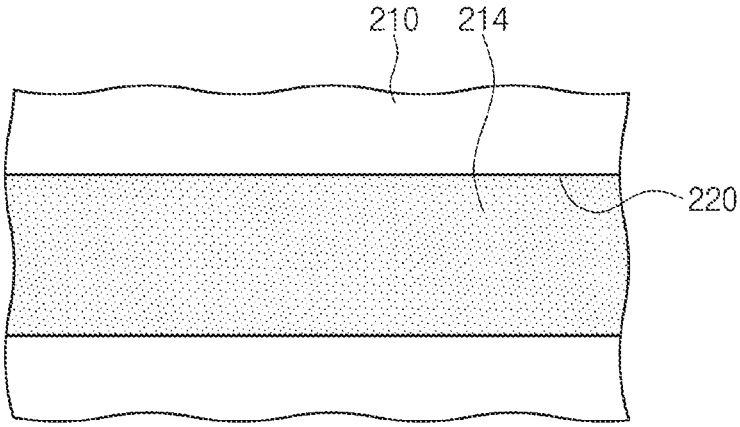

Hereinafter, an example in which the bio-reaction is performed by using the bio-reaction apparatus will be described. FIGS. 10 and 11 are views for explaining the example in which the bio-reaction is performed by using the bio-reaction apparatus and enlarged views of a portion of the biochip.

First, referring to FIGS. 6A and 10, the biochip 200 may be a biochip for an immune reaction in this example. In this case, a first antibody 212 for performing the immune reaction may be fixed to the inner wall of the reagent transfer channel 220. First, to perform the immune reaction, a biological sample such as blood having an antigen may be injected into the reagent transfer channel 220. The biological sample may be injected through a biological sample injection hole (not shown) separately defined in the body part 210. Accordingly, the immune reaction between the first antibody 212 and the antigen may occur. Thereafter, according to the method described with reference to FIGS. 9A to 9E, the plural kinds of reagents 130 may be sequentially provided into the reagent transfer channel 220 of the biochip 200. In this example, the plural kinds of reagents 130 may include a washing buffer, a labeled secondary antibody, and a substrate buffer. Accordingly, the immune reaction may be performed in the biochip 200.

An immune reaction signal generated by the immune reaction may be measured by using a color reaction method, a chemical luminescence method, a staining signal amplification method, and the like. For example, when the immune reaction signal is measured by using an optical method, light is incident into the reagent transfer channel 220 before and after the immune reaction is performed by using an optical signal generator, and then variation in the optical signal is measured by using the optical signal measuring device to measure whether the target material (i.e., biomarker) is exist and an amount of the target material.

Referring to FIGS. 6A and 11, the biochip 200 in this example may be a biochip for a gene pretreatment. In this case, a solid substrate 214 may be provided in the reagent transfer channel 220. For the gene pretreatment, firstly, the biological sample such as blood may be injected into the reagent transfer channel 220. The biological sample may be injected through the biological sample injection hole (not shown) separately defined in the body part 210. Thereafter, according to the method described with reference to FIGS. 9A to 9E, the plural kinds of reagents 130 may be sequentially transferred into the reagent transfer channel 220 of the biochip 200. In this example, the plural kinds of reagents 130 may include a cell lysis buffer, a washing buffer, and an elution buffer. The cell lysis buffer may be first provided into the transfer channel 220 to crush the cell, and the gene in the cell may be bound to the solid substrate 214. Thereafter, as the washing buffer and the elution buffer are sequentially provided into the reagent transfer channel 220, the bound gene may be eluted.

Figure 12:
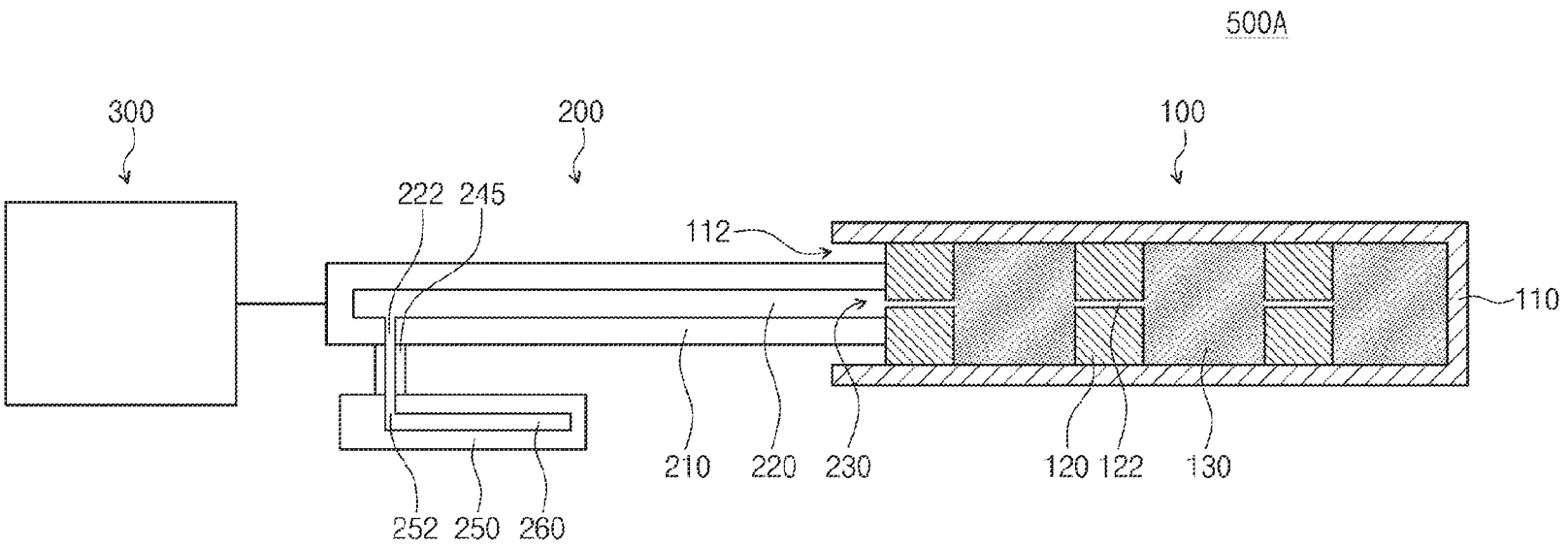
FIG. 12 is a view for explaining the bio-reaction apparatus according to embodiments of the inventive concept.

FIG. 12 is a view for explaining the bio-reaction apparatus according to embodiments of the inventive concept. A bio-reaction apparatus 500A in FIG. 12 may be substantially the same as the bio-reaction apparatus 500 in FIG. 6A except for the configuration of the biochip 200. Overlapped description regarding the configuration will be omitted for simplicity of description.

Referring to FIG. 12, the biochip 200 may include a first body part 210, a second body part 250, and a connecting part 245. The first body part 210 may include a first reagent injection hole 230, a first reagent transfer channel 220, and a first reagent discharge hole 222. The second body part 250 may include a second reagent injection hole 252, and a second reagent transfer channel 260. The connecting part 245 may include a transfer passage connecting the first reagent discharge hole 222 to the second reagent injection hole 252.

One end of the first body part 210 may be connected to the diaphragm 120 of the reagent storage device 100, and the second body part 250 may be connected to the first body part 210 through the connecting part 245. The reagents 130 provided from the reagent storage device 100 may be transferred to the second reagent transfer channel 260 through the first reagent injection hole 230, the first reagent transfer channel 220, the first reagent discharge hole 222, and the second reagent injection hole 252. According to the embodiment, the target material may be provided to the second reagent transfer channel 260, and, accordingly, the bio-reaction may be performed in the second reagent transfer channel 260. Meanwhile, the second body part 250 may further include a discharge hole (not shown) for discharging the reagents 130 transferred into the second reagent transfer channel 260 and/or a biological sample injection hole (not shown) for injecting the biological sample into the second reagent transfer channel 260.

According to the embodiments of the inventive concept, as the reagents and the diaphragms are alternately injected and installed in the barrel shaped storage container having the opened inlet, the reagent storage device capable of storing the plural kinds of reagents may be realized. Accordingly, the reagent storage device capable of being manufactured at a low cost and maintaining the homeostasis of the reagents may be provided.

According to the embodiments of the inventive concept, the external force may be applied to the diaphragms connected to the biochip by using the simple driving member to sequentially and linearly move the diaphragms, and the reagents pressed by the linear movement of the diaphragms may pass through the through-holes respectively defined in the diaphragms and be sequentially provided into the biochip. Accordingly, the reagent storage device capable of providing the reagents with reproducibility through the simple operation and the bio-reaction apparatus including the same may be provided.

The description of the present invention is intended to be illustrative, and those with ordinary skill in the technical field of the present invention will be understood that the present invention can be carried out in other specific forms without changing the technical idea or essential features. Therefore, the embodiments described above include exemplary in all respects and not restrictive, but it should be understood.

What is claimed is:

1. A reagent storage device connected to a biochip to provide reagents into the biochip, the reagent storage device comprising:

a storage container having a tube shape of which one end is opened and configured to receive an end of the biochip, and the other end opposite to the one end is closed and fixed so as not to move; and a plurality of diaphragms provided in the storage container and installed to be closely attached to an inner wall of the storage container, wherein the diaphragms are spaced apart from each other in one direction in which the one end and the other end are disposed opposite to each other, and each of the diaphragms comprises a through-hole passing therethrough, wherein a first diaphragm closest to the opened one end of the storage container is configured to receive an external force applied by the biochip, and wherein the reagents are provided into the biochip in a direction opposite to a direction in which the external force is applied to the first diaphragm from the biochip, and wherein as the reagents are provided into the biochip an amount of moving diaphragms increases.

2. The reagent storage device of claim 1, wherein the storage container has a plurality of storage spaces separated by the diaphragms, the reagents are respectively stored in the plurality of storage spaces, and at least some of the reagents are different from each other in kind.

3. The reagent storage device of claim 2, wherein the diaphragms comprise the first diaphragm and a second diaphragm, which are disposed from an inlet of the storage container in the one direction, and the reagents comprises a first reagent disposed between the first diaphragm and the second diaphragm and a second reagent separated from the first reagent with the second diaphragm therebetween, wherein the first diaphragm moves toward the second diaphragm by the external force applied thereto, and while the first diaphragm moves, the first reagent is discharged to the outside of the storage container through the through-hole of the first diaphragm.

4. The reagent storage device of claim 3, wherein, while the first reagent is discharged, a position of the second diaphragm is maintained.

5. The reagent storage device of claim 1, wherein the through-hole completely passes through the corresponding diaphragm in the one direction, and a ratio of a diameter of the through-hole to a length of the through-hole is about 0.02 to about 0.2.

6. The reagent storage device of claim 1, wherein the through-holes of the diaphragms are aligned with each other in a straight line parallel to the one direction.

7. The reagent storage device of claim 1, wherein each of the diaphragms is made of a material having elasticity.

8. The reagent storage device of claim 1, wherein the through-hole is filled with air or oil.

9. A bio-reaction apparatus comprising:

a biochip configured to perform a bio-reaction; and a reagent storage device connected to one end of the biochip, wherein the reagent storage device comprises:

a barrel-shaped storage container having an opened inlet and a closed end opposite to the opened inlet, the closed end being fixed so as not to move;

a plurality of diaphragms installed in the storage container so as to be closely attached to an inner wall of the storage container, wherein each of the plurality of diaphragms comprises a through-hole passing therethrough; and reagents respectively stored in storage spaces, which are separated by the diaphragms, of the storage container, wherein the reagent storage device is configured to sequentially provide the reagents into the biochip, wherein the reagents are provided into the biochip in a direction opposite to a direction in which an external force is applied to the diaphragms from the biochip, and wherein as the reagents are provided into the biochip an amount of moving diaphragms increases.

10. The bio-reaction apparatus of claim 9, wherein a diaphragm, which is the most adjacent to the inlet, of the diaphragms is defined as a first diaphragm, and the biochip comprises a body part having a tube shape and a reagent transfer channel in the body part, wherein the body part has an end connected to the first diaphragm, and the reagents are transferred to the reagent transfer channel.

11. The bio-reaction apparatus of claim 10, wherein the biochip further comprises a reagent injection hole provided in the one end of the body part and connected to the reagent transfer channel, and the reagent injection hole is connected to the through-hole of the first diaphragm.

12. The bio-reaction apparatus of claim 11, further comprising a connecting member disposed between the one end of the body part and the first diaphragm, wherein the connecting member comprises a connecting passage configured to connect the reagent injection hole to the through-hole of the first diaphragm.

13. The bio-reaction apparatus of claim 10, further comprising a driving member connected to the other end of the biochip, which is disposed opposite to the one end, wherein the driving member is configured to apply the external force to the first diaphragm through the biochip.

14. The bio-reaction apparatus of claim 13, wherein a diaphragm, which is disposed adjacent to the first diaphragm of the diaphragms is defined as a second diaphragm, and a reagent, which is disposed between the first diaphragm and the second diaphragm, of the reagents is defined as a first reagent, wherein the first diaphragm linearly moves toward the second diaphragm by the applied external force, and while the first diaphragm linearly moves, the first reagent is transferred to the reagent transfer channel.

15. The bio-reaction apparatus of claim 14, wherein, while the first reagent is transferred to the reagent transfer channel, a position of the second diaphragm is maintained.

16. The bio-reaction apparatus of claim 10, wherein a target material for performing the bio-reaction is provided in the reagent transfer channel.

17. The bio-reaction apparatus of claim 10, wherein the body part is defined as a first body part, and the reagent transfer channel is defined as a first reagent transfer channel, and the biochip comprises:

a second body part;

a second reagent transfer channel in the second body part; and a connecting part configured to connect the first reagent transfer channel to the second reagent transfer channel.

18. The bio-reaction apparatus of claim 17, wherein the reagents are transferred to the second reagent transfer channel through the first reagent transfer channel and the connecting part, and a target material for performing the bio-reaction is provided to the second reagent transfer channel.

19. The bio-reaction apparatus of claim 9, wherein the through-holes of the diaphragms are aligned with each other in a straight line parallel to one direction in which the diaphragms are disposed.

20. The bio-reaction apparatus of claim 9, wherein each of the diaphragms is made of a material having elasticity.

* * * * *